US005545015A

United States Patent [19]

Scherrer

[11] Patent Number: 5,545,015

[45] Date of Patent: Aug. 13, 1996

[54] SELF-COOLED AND REMOVABLE INTEGRATED CRYOGENIC LIQUID PUMP

[75] Inventor: Norbert Scherrer, St. Just, France

[73] Assignee: Societe Europeene de Propulsion, Suresnes, France

[21] Appl. No.: 253,356

[22] Filed: Jun. 3, 1994

[30] Foreign Application Priority Data

Jun. 11, 1993 [FR] France ..... 93 07088

[51] Int. Cl.[6] ..... F17C 13/02

[52] U.S. Cl. ..... 417/360; 417/901; 62/50.6

[58] Field of Search ..... 417/360, 901; 62/50.6

[56] References Cited

U.S. PATENT DOCUMENTS

| | | | |
|---|---|---|---|
| 1,895,295 | 1/1933 | Picard | 417/901 X |
| 2,018,144 | 10/1935 | Mesinger | 417/901 X |
| 3,431,744 | 3/1969 | Veilex et al. | 62/50.6 |
| 3,435,629 | 4/1969 | Hallenburg | 62/50.6 X |
| 3,973,868 | 8/1976 | Weisser | 417/360 X |
| 4,080,106 | 3/1978 | Haesloop | 417/360 X |
| 4,174,791 | 11/1979 | Auchter | 417/360 X |
| 4,418,544 | 12/1983 | Heybutzki et al. | 417/901 X |
| 4,472,946 | 9/1984 | Zwick | 62/50.6 |
| 4,792,289 | 12/1988 | Nieratschker | 417/901 X |
| 4,915,602 | 4/1990 | Tschopp | 417/901 X |

*Primary Examiner*—Richard E. Gluck

*Attorney, Agent, or Firm*—Weingarten, Schurgin, Gagnebin & Hayes

[57] ABSTRACT

The invention relates to a cryogenic liquid pump provided with a pump body driven by a motor assembly and integrated in a cryogenic liquid tank. The pump body is removable and can be put selectively in communication with the tank by sliding the pump body into a well. A first non-return valve enables transfer of liquid from the tank to the pump body via an outlet orifice. A second non-return valve enables flow of cold gas from the gas overhead of the tank towards a rear end of the pump body from which it exhausted to the outside via a sweeping/venting orifice. The sweeping/venting orifice outlet is preferably provided with a device for adjusting the flow rate of cold gas leaving the pump body.

9 Claims, 4 Drawing Sheets

SELF-COOLED AND REMOVABLE INTEGRATED CRYOGENIC LIQUID PUMP

FIELD OF THE INVENTION

The present invention relates to a self-cooled cryogenic liquid pump designed to be integrated in removable manner in a cryogenic liquid tank and either enabling said liquid to be transferred at moderate pressure, or else enabling gas to be produced at high pressure. Nitrogen, argon, oxygen, hydrogen and liquid helium are the substances that are most particularly concerned with such a device.

PRIOR ART

Conventionally, liquid pumps as used under cryogenic conditions, be they of the centrifugal type or of the piston type, are placed outside the source of liquid. This gives rise to numerous drawbacks, of which the main drawback is associated with the need to pre-cool the pump before starting it. Pre-cooling must be performed by implementing complex cycles that naturally cause the pump to be unavailable while they are taking place. In addition, in such prior art devices, the only use that is genuinely commonplace is based on liquid nitrogen. For example, high pressure pumps are not available that operate with liquid helium, and it is therefore necessary to compress that liquid in gaseous form in order to enable it to be used, and that is highly penalizing both in terms of energy and in terms of investment, i.e. in overall cost. A similar problem arises when using liquid hydrogen.

U.S. Pat. No. 4,472,946 attempts to provide a solution to the above problems by proposing that the pump should be immersed in the cryogenic liquid (and in particular liquid nitrogen). However, the shaft line of such a pump turns out to be particularly fragile, thereby putting a limit on the requisite reliability that can be expected of such a device.

Another solution is taught by U.S. Pat. No. 2,018,144 which discloses a pump integrated in a liquefied gas tank at low pressure. However, since that pump is secured to the tank, it is naturally not possible to remove it in service, and that is particularly troublesome if ever it is observed that the pump is not operating properly. Furthermore, since that pump does not ensure complete control over pressure, it is quite possible for gas to be expelled via its outlet and not only via its venting duct. Finally, and above all, since the pump is not at the same temperature as the liquid, the temperature difference that exists between its cold inside and its hot outside has the effect of giving rise to thermal shocks that are harmful to operation of the pump.

BRIEF SUMMARY OF THE INVENTION

An object of the present invention is to mitigate the above-mentioned drawbacks and to provide a self-cooled and removable cryogenic liquid pump capable of being used with any type of cryogenic liquid, and in particular with liquid hydrogen and liquid helium. Another object of the invention is to provide a pump of a structure that is simple and reliable and that enables pressure to be fully controlled, thus making the pump particularly adaptable to different operating conditions.

These objects are achieved by a cryogenic liquid pump having a pump body and being driven by a motor assembly and integrated in a cryogenic liquid tank. The pump body is removable and can be put selectively in communication with the tank by sliding the pump body into a well. A first non-return valve enables transfer of liquid from the tank to the pump body via an outlet orifice. A second non-return valve enables flow of cold gas from the gas overhead of the tank towards a rear end of the pump body from which is it exhausted to the outside via a sweeping/venting orifice. The sweeping/venting orifice outlet is provided with a device for controlling the flow rate of cold gas leaving the pump body.

The adjustment device makes it possible to render the flow rate of cold gas removed to the outside more uniform, which flow may be the result, for example, of additional heat due to friction losses in the pump.

In a first embodiment, the first and second non-return valves are put in the open position during installation and fastening of the pump body in the well by means of a double-headed driver fixed at a front end of said pump body and acting on each of said non-return valves in order to cause them to open.

In a second embodiment, the second non-return valve is put into the open position while the pump body is being installed and fastened in the well by means of a driver fixed to a front end of the pump body that causes the non-return valve to open, and wherein the first non-return valve is put into the open position by a control device external to the pump body.

Advantageously, the pump includes sealing devices placed respectively between the well and the pump body, and between the well and the outside.

In a first variant applicable to either of the above embodiments, the pump body is coupled to a sealed motor the assembly constituted by said two elements being isolated from the outside by a sealed link that connects them together. In a second variant, the pump body is coupled to a motor having an immersed rotor, the stator being separated from the rotor by a sealed jacket secured to the pump body.

In each of these variants, the sealed partition formed by the link or the jacket includes a venting orifice.

Such separation of the stator from the immersed rotor is advantageous when the fluid used is incompatible with the materials employed in the stator (e.g. it is corrosive). In the extreme, by using a motor that is entirely sealed, it becomes possible to use components that are known and reliable, thereby achieving a corresponding reduction in the cost of the pump.

When the cryogenic liquid pump is designed to be mounted on a double-walled tank, the pump body is preferably mounted on the inside wall of the tank, a sealed link connecting the outside wall of the tank to the side wall of the well and making it possible to leave the space between the walls at the vacuum pressure to which it is subjected prior to installing the pump.

Depending on the required use and performance, the pump of the invention may be a centrifugal pump, an axial pump, or a piston pump, without the invention being limited to that list.

BRIEF DESCRIPTION OF THE DRAWINGS

Other characteristics and advantages of the present invention appear more clearly from the following description given by way of non-limiting example and made with reference to the accompanying drawings, in which.

DESCRIPTION OF PARTICULAR EMBODIMENTS

Figure 1:
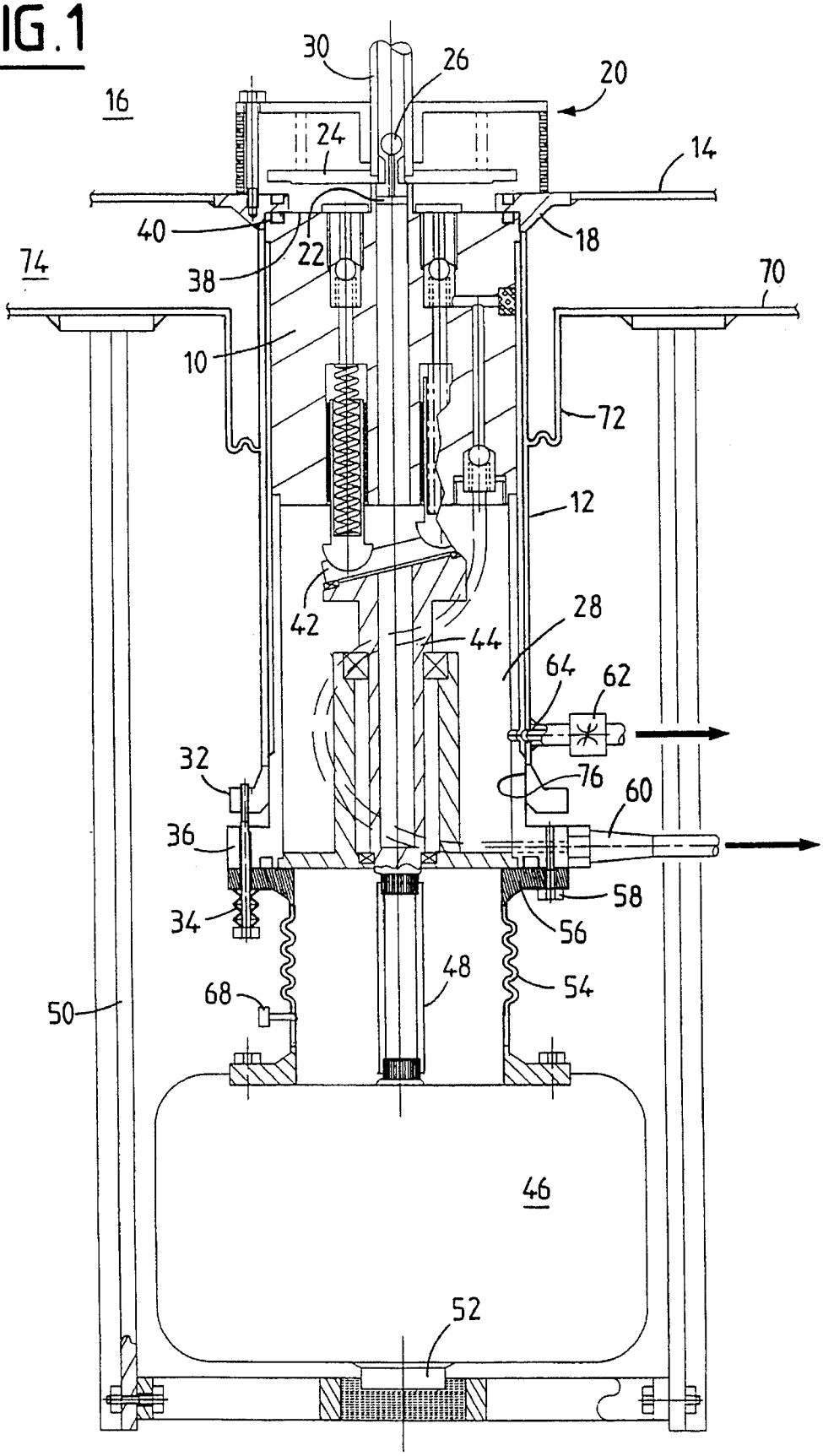
FIG. 1 is a section view of a cryogenic liquid piston pump provided with a sealed motor.

FIG. 1 shows a first embodiment of a cryogenic liquid pump of the invention. The cryogenic pump described with reference to this figure is a high pressure piston pump designed to produce gas and driven by a sealed electric motor. Naturally, the invention is not limited to that type of pump only and it would equally be possible to use an axial pump, a centrifugal pump (see FIGS. 2 and 3 for example) or any other type of pump. Similarly, it is not essential to use an electric motor, and any type of motor could be used, e.g. a hydraulic motor, a pneumatic motor, or a heat engine, not excluding gas turbines, for example.

The pump of the invention comprises a pump body 10 capable of being slidably installed in a well 12 having a first end 18 that is securely fixed, e.g. by welding, to a wall 14 of a tank containing a cryogenic liquid. This first end of the well is closed by a non-return device 20 which is opened, during installation of the pump body in the well, thereby putting the tank into communication with the well, by the action of a driver 22 in the form of a double-headed peg acting on the seat of the non-return device. The non-return device includes a first non-return valve 24 which on being raised by the double-headed driver 22 causes cryogenic liquid to pass into the pump body, and a second non-return valve 26 which on being raised by the same double-headed driver 22 enables the gas overhead of said tank to communicate with the rear portion 28 of the pump body, said communication being made possible by the presence of a tube 30 passing through the tank between the non-return valve constituting the liquid draw-off point and the gas overhead. The free end of the well 12 is terminated by an outside collar 32 onto which there is fixed by means of a screw and washer assembly 34 a first end 36 of the pump body, an opposite end 38 of said pump body being contact with the tank. A gasket 40 placed at said second end 38 and whose compression pressure is determined by the screw and washer assembly 34 provides sealing between the well and the pump body and limits differential expansion between these two elements. When the pump is partially withdrawn, collar gaskets 76 provide sealing between the side wall of the well and the outside.

The body of the piston pump is actuated by a rotary swashplate assembly 42 driven by a shaft 44 itself connected to a sealed electric motor 46 by means of a coupling 48. The motor 46 is mechanically decoupled with respect to force from the pump by means of a support structure 50 (which may advantageously be fixed to the wall of the tank) serving to center the motor by means of a stub axle 52. A deformable sealed link 54 provides sealing (a gasket 56 being held pressed against the end 36 of the pump body by fasteners 58) and insulation of the entire device of the invention relative to the outside.

Fluid is removed via an outlet duct 60 connected to the rear end (in the pump insertion direction) 36 of the pump body. An adjustment device 62 is placed at the outlet of a sweeping/venting orifice 64 that opens to the side wall of the well 12 and to the inside of the front body 10 substantially level with the free end 32 of the well. Similarly, a second venting orifice 68 is present level with the deformable sealed link 54.

Advantageously, the tank 16 may be provided with a second wall 70, a second deformable link 72 then connecting it to the side wall of the well 12 in sealed manner, the space 74 between the two walls of the tank being at vacuum pressure.

The pump of the invention operates as follows. It is recalled that installing the pump body in the well causes the well to be put into communication with the tank, and in particular causes the gas overhead of the tank (which is naturally at a higher pressure than the outside, since any closed cryogenic tank rises in pressure) into communication with the rear portion of the pump body. Then, by opening the adjustment device it is possible to establish a flow of cold gas to the outside which will have the effect of naturally cooling the pump body assembly by compensating for heat input to the device, thereby enabling the pump to be started immediately. Once the pump has been started and is in operation, excess heat due in particular to friction losses in the pump body is likewise dumped via the sweeping/venting orifice, the adjustment device then having a larger aperture in order to remove the additional heat. Naturally, the outlet line must be thermally compatible with the fluid used, and it may be necessary to use an outlet line that is lagged or vacuum insulated, for example.

In the event of the pump misfunctioning, it is simple to remove it and to replace it. By disconnecting the pump body from the well (after the motor has previously likewise been disconnected from its support) it is possible to slide it along the well (the pump theoretically being mounted vertically), while simultaneously causing the non-return valve device to close, thereby cutting off the feed of liquid to the pump and establishing the cold gas flow, sealing between the well and the outside being nevertheless maintained because of the presence of the collar gaskets. During such extraction, care is taken to inject a gas of determined composition via the sweeping/venting orifice 64 to prevent any ingress of air, such sweeping being maintained during installation and coupling of a new pump.

Thus, it is possible to install the new pump very quickly and since the internal assembly of the pump is prepared via the orifice 68 with the same fluid as that with which it is going to operate, any risk of pollution by ambient air is eliminated and the complex drainage operations that used to be essential are thus avoided.

By means of this rapid replacement option, the cryogenic pump of the invention offers exceptional availability, thus improving on its suitability for instantaneous starting that is made possible by cold gas being taken from the inside of the cryogenic liquid tank.

Figure 2:
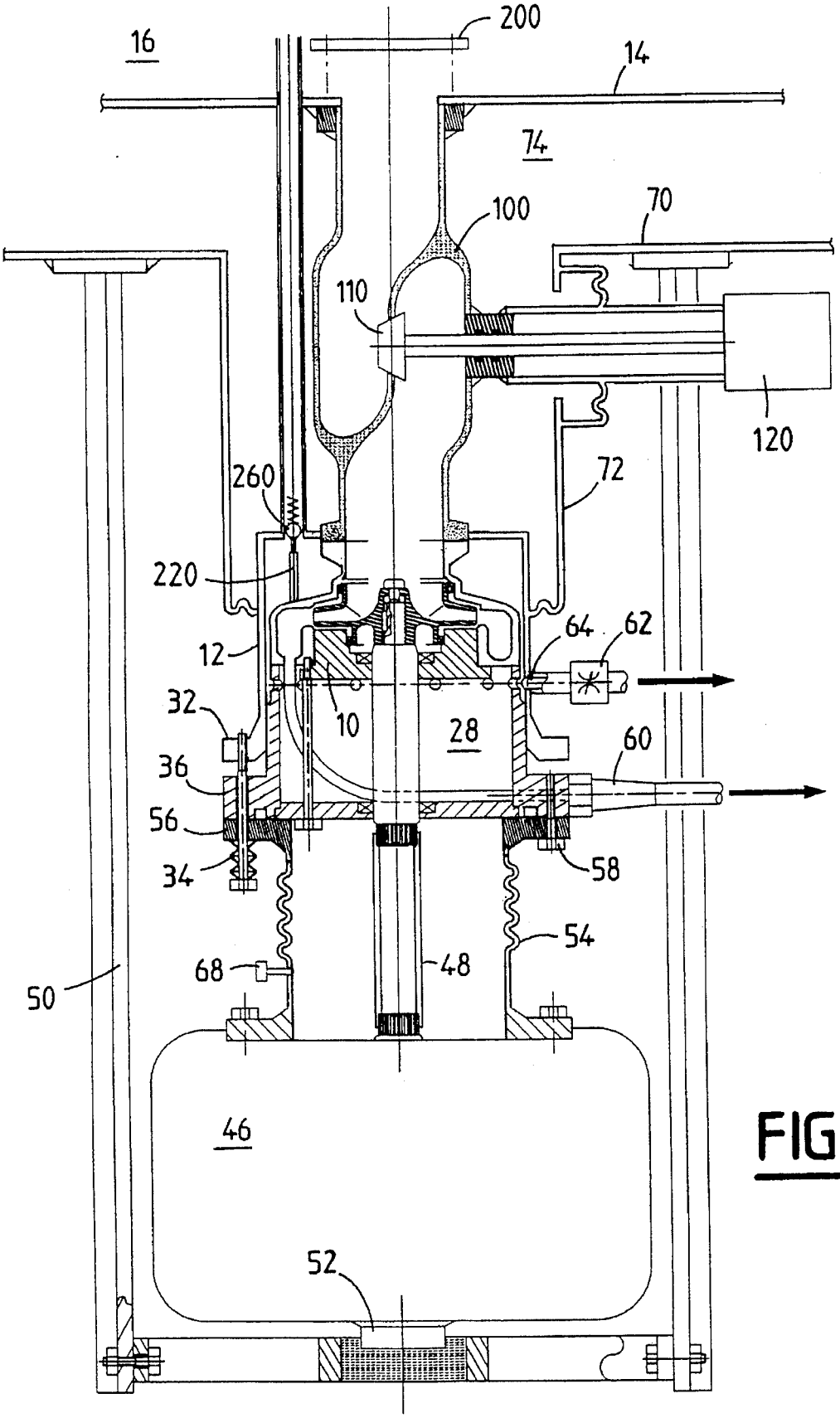
FIG. 2 is a section view of a cryogenic liquid centrifugal pump provided with a sealed motor.

FIG. 2 shows a second embodiment of a cryogenic liquid pump of the invention. The pump now described is a centrifugal pump having a sealed electric motor. Elements that it shares in common with the pump of FIG. 1 are given the same references. This applies to the tank 16 having double walls 14 and 70; to the motor 46, its coupling 48, its support 50, and the sealed link 54 with the pump body; to the fasteners 34 and 58 between the end of the pump body 26 and the collar 32 of the well and said sealed link 54, respectively; to the venting and fluid outlets 64, 62 and 60; and finally when a double walled tank is in use, to the sealed link 72 with the well 12.

The body of the centrifugal pump 10 is connected to a valve body 100 including a seat 110 that is opened under the control of a control assembly 120, and the turbine 130 causes liquid to be pumped as soon as said seat is opened. A driver 220 placed on the valve body operates during installation of the pump to open a non-return valve 260 that puts the gas overhead of the tank into communication with the rear of the pump body. A filter 200 is placed at the inlet of the valve body at the level of the tank 16.

This pump operates substantially identically to the preceding pump (naturally as a function of operating conditions: the centrifugal pump for transferring liquid operating at low pressure whereas the preceding piston pump operating at high or medium pressure), with the exception of transfer of the liquid from the tank to the pump which can be started in this embodiment under the control of the control assembly 120. As before, the device is cooled down immediately, with the fact of installing the pump in the well having the effect of opening the valve 260 and thus of causing a flow of cold gas to be established through the pump.

Figure 3:
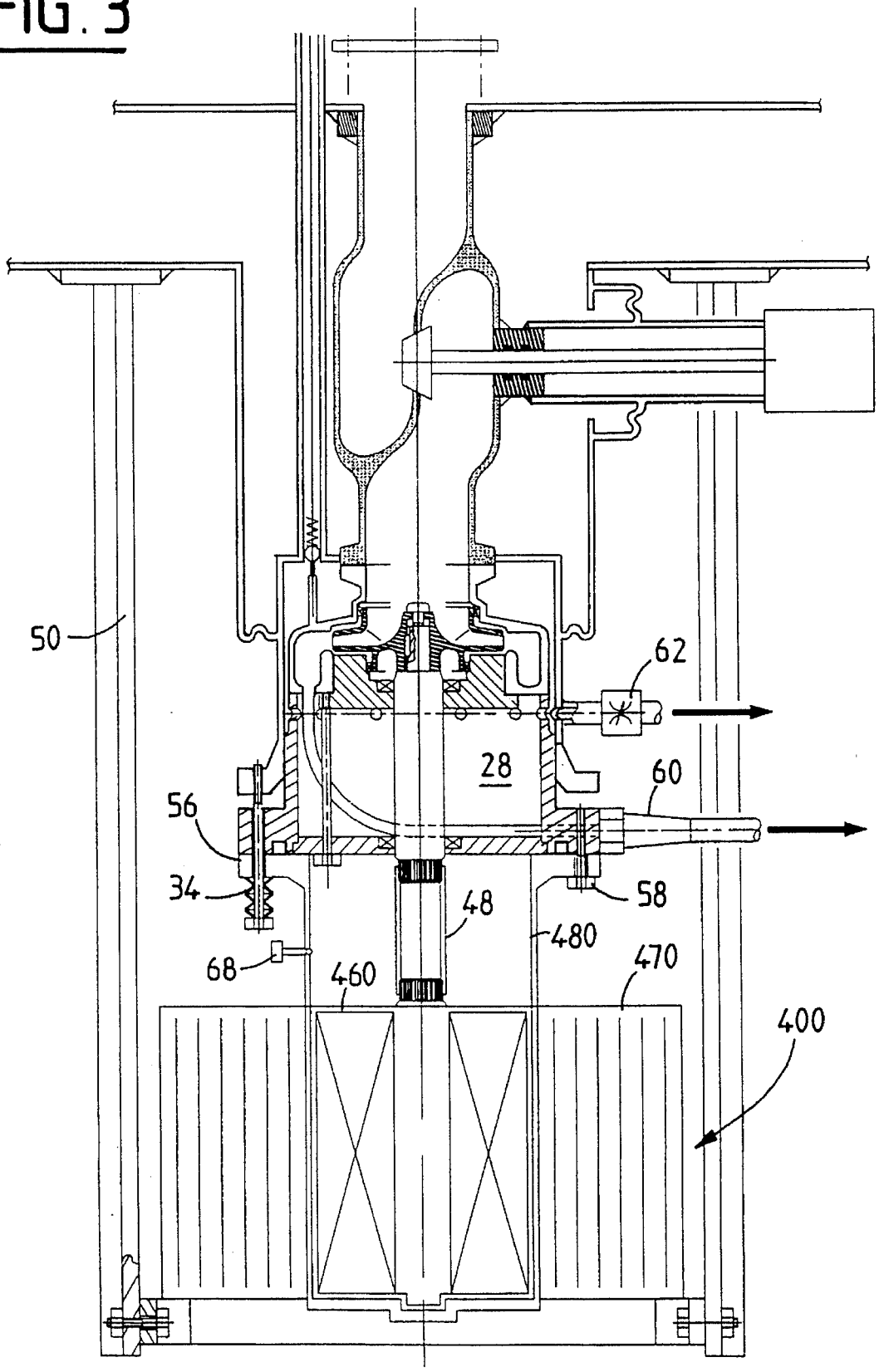
FIG. 3 is a section view of a cryogenic liquid centrifugal pump provided with a semi-immersed motor.

FIG. 3 shows a variant embodiment of the cryogenic liquid pump of FIG. 2 in which the motor 400 controlling the pump is of the semi-immersed type having a rotor 460 that is subjected to the action of cold gas coming from the tank, and a stator 470 that is isolated therefrom by an air gap jacket 480 secured to the pump body by fasteners 58. As before, a venting member 68 is present but is now placed on the jacket 480. It may be observed that this configuration is particularly advantageous when the materials of the rotor are compatible with the kind of gas present inside the pump body.

Figure 4:
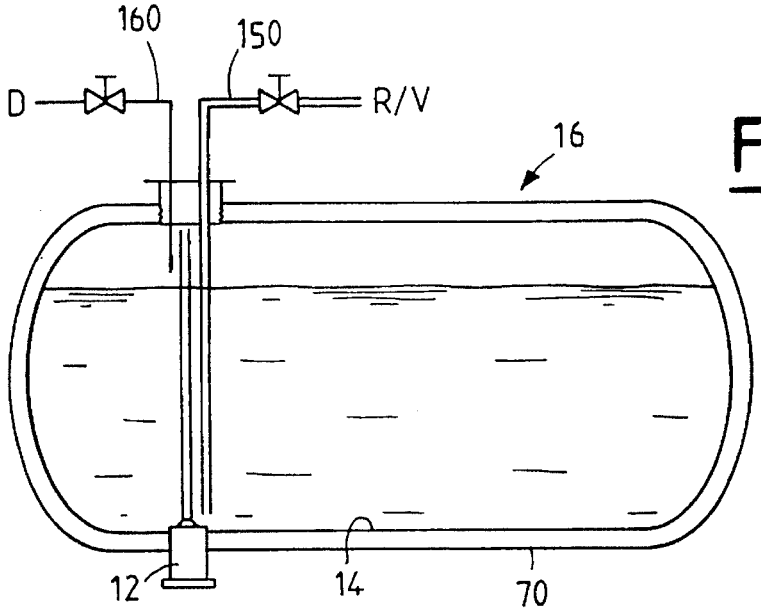
FIGS. 4 to 6 show examples of how pumps of the invention may be disposed in cryogenic tanks of different shapes.
Figure 5:
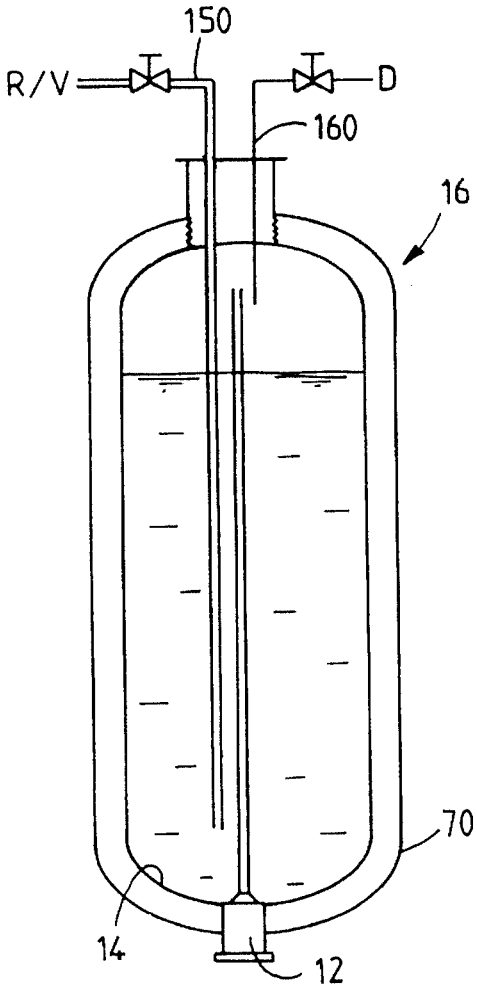
Figure 6:
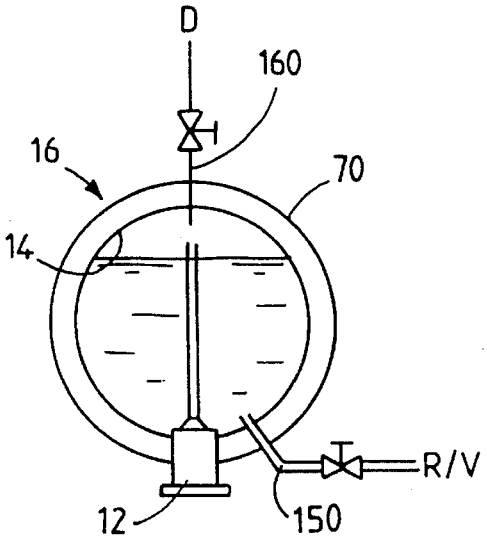

FIGS. 4 to 6 are diagrams showing examples of how the pump of the invention can be disposed on different shapes of cryogenic liquid tank. Each of them includes a filling/emptying line 150 and a degassing line 160. Naturally, there can be found the well 12 (the pump and the motor are not shown) and also the tube 30 for drawing off cold gas from the gas overhead inside the tank. The well is advantageously placed at the bottom of the tank and the degassing line at the top thereof. The filling line is preferably likewise placed at the bottom of the tank. It should be observed that the simplicity of the external structure of the invention makes it suitable for adapting to tanks of all type: horizontal, vertical, or spherical, for example.

I claim:

1. A cryogenic liquid pump provided with a pump body driven by a motor assembly and integrated in a cryogenic liquid tank, wherein said pump body is removable and can be put selectively in communication with the tank by sliding in a well, a first non-return valve making it possible when in the open position to transfer liquid from the tank to the pump body prior to evacuation thereof in the form of a liquid or a gas via an outlet orifice, and a second non-return valve making it possible, when in the open position, to establish a flow of cold gas from a gas overhead of the tank towards a rear end of the pump body from which it is exhausted to the outside via a sweeping/venting orifice.

2. A cryogenic liquid pump according to claim 1, wherein the sweeping/venting orifice is provided at its outlet with a device for adjusting the flow rate of cold gas leaving the pump body.

3. A cryogenic liquid pump according to claim 1, wherein the first and second non-return valves are put in the open position during installation and fastening of the pump body in the well by means of a double-headed driver fixed at a front end of said pump body and acting on each of said non-return valves in order to cause them to open.

4. A cryogenic liquid pump according to claim 1, wherein the second non-return valve is put into the open position while the pump body is being installed and fastened in the well by means of a driver fixed to a front end of the pump body that causes the second non-return valve to open, and wherein the first non-return valve is put into the open position by a control device external to the pump body.

5. A cryogenic liquid pump according to claim 1, including sealing devices placed respectively between the well and the pump body, and between the well and the outside.

6. A cryogenic liquid pump according to claim 1, wherein the pump body is coupled to a sealed motor by a sealed link, said pump body add said sealed motor being isolated from the outside by said sealed link.

7. A cryogenic liquid pump according to claim 1, wherein the pump body is coupled to a motor having an immersed rotor, a stator being separated from the rotor by a sealed jacket secured to the pump body.

8. A cryogenic liquid pump according the claim 6, wherein a second venting orifice is connected through said sealed link.

9. A cryogenic liquid pump according to claim 1, designed to be mounted on a double-walled tank having first and second walls with a space being defined therebetween, said pump including a second sealed link which seals an opening in the tank to allow connection of the second wall to a side wall of the well such that the space defined between the first and second walls can remain at a vacuum pressure while the pump is moved and operated.

* * * * *